US009629764B2

(12) United States Patent
Rombough

(10) Patent No.: US 9,629,764 B2
(45) Date of Patent: Apr. 25, 2017

(54) WHEELCHAIR LEG COVERING

(71) Applicant: Bunnie Rombough, Edmonton (CA)

(72) Inventor: Bunnie Rombough, Edmonton (CA)

( * ) Notice: Subject to any disclaimer, the term of this patent is extended or adjusted under 35 U.S.C. 154(b) by 0 days.

(21) Appl. No.: 14/555,929

(22) Filed: Nov. 28, 2014

(65) Prior Publication Data

US 2015/0265479 A1 Sep. 24, 2015

Related U.S. Application Data

(60) Provisional application No. 61/954,848, filed on Mar. 18, 2013.

(51) Int. Cl.
*A61G 5/10* (2006.01)
*A61G 5/12* (2006.01)

(52) U.S. Cl.
CPC ..... *A61G 5/10* (2013.01); *A61G 5/127* (2016.11); *A61G 5/128* (2016.11)

(58) Field of Classification Search
CPC . A47G 9/066; A47G 9/08; A47G 9/06; A61G 5/127; A61G 5/128; A61G 5/10
USPC ..... 2/69, 69.5, 82, 87
See application file for complete search history.

(56) References Cited

U.S. PATENT DOCUMENTS 704,276 A * 7/1902 Sorensen ..... A41D 13/0015 2/69
2,230,689 A * 2/1941 Kemp ..... A47G 9/066 2/69
2,459,352 A * 1/1949 Williams ..... A47G 9/066 2/69
2,707,988 A * 5/1955 Shaub ..... B62B 9/142 2/69.5
2,712,133 A * 7/1955 Coleman ..... A61G 5/10 2/69
2,716,239 A * 8/1955 Barndollar ..... A41B 13/06 2/69.5
3,380,370 A * 4/1968 Mack ..... E04H 15/14 135/93
3,597,764 A * 8/1971 Povey ..... A41D 15/04 2/69.5

(Continued)

FOREIGN PATENT DOCUMENTS

JP 10292212 A * 11/1998

*Primary Examiner* — Anna Kinsaul
*Assistant Examiner* — Griffin Hall
(74) *Attorney, Agent, or Firm* — Global Intellectual Property Agency, LLC; Daniel Boudwin

(57) ABSTRACT

A leg covering adapted for use with a wheelchair. The present leg covering includes an outer covering having a closed end, an open end, and one or more straps positioned adjacently to the open end such that the covering can be secured to the armrests of a wheelchair once drawn over the user's legs. The leg covering further comprises a liner removably insertable therein, which provides an additional layer of insulating material for especially cold or otherwise inclement weather conditions. The outer covering additionally has a zipper disposed on the front portion thereof to provide other individuals with the ability to access to catheters, colostomy bags, or other such objects stored beneath the covering in a discrete manner. The liner has a front slit or opening aligned with the outer covering zipper so that it does not act as an impediment to accessing the internal volume of the covering.

14 Claims, 3 Drawing Sheets

(56) References Cited

U.S. PATENT DOCUMENTS 3,669,107 A * 6/1972 Posey ..... A61G 5/10 128/845
4,363,141 A * 12/1982 Doster ..... A47G 9/066 2/69.5
5,283,909 A * 2/1994 Hill ..... A47G 9/066 2/22
5,604,932 A * 2/1997 Lawicki ..... A47G 9/066 2/46
5,956,766 A * 9/1999 Benway ..... B62B 9/10 2/69
D430,079 S * 8/2000 Catron-Batts ..... D12/133
6,105,168 A * 8/2000 Hazen ..... A41B 13/06 2/69.5
D434,205 S * 11/2000 Kapszukiewicz ..... D2/860
6,311,330 B1 * 11/2001 Rothman ..... A47G 9/066 2/69
7,036,153 B2 * 5/2006 Gibson ..... A47C 7/021 2/69
7,127,753 B1 * 10/2006 Ramaley ..... A47G 9/086 135/137
7,581,259 B2 * 9/2009 Thompson ..... A47G 9/066 2/69.5
8,079,099 B1 * 12/2011 Brown ..... A47G 9/066 2/69.5
2002/0129445 A1 * 9/2002 Deering ..... A47G 9/066 5/482
2006/0266294 A1 * 11/2006 Holmes ..... A01K 1/0353 119/28.5
2007/0061965 A1 * 3/2007 Crawford ..... A47G 9/086 5/413 R
2007/0245443 A1 * 10/2007 Vereen ..... A41B 1/00 2/69
2008/0235870 A1 * 10/2008 Heide ..... A47G 9/04 5/484
2009/0025118 A1 * 1/2009 Pothier ..... A47G 9/066 2/69.5
2010/0192298 A1 * 8/2010 Michaelis ..... A47G 9/086 5/413 R
2010/0199402 A1 * 8/2010 Curtis ..... A47G 9/066 2/69
2010/0263104 A1 * 10/2010 Flannery ..... A47G 9/066 2/69
2012/0284915 A1 * 11/2012 Najari Ehsani ..... A47G 9/086 5/120
2013/0007941 A1 * 1/2013 Smith ..... A41D 13/1236 2/93
2014/0165257 A1 * 6/2014 Wynh ..... A41B 13/06 2/69.5
2016/0051068 A1 * 2/2016 Romeo ..... A47G 9/086 5/413 AM
2016/0192792 A1 * 7/2016 Townsend ..... A41D 13/0012 5/484

* cited by examiner

WHEELCHAIR LEG COVERING

CROSS REFERENCE TO RELATED APPLICATION

This application claims the benefit of U.S. Provisional Application No. 61/954,848 filed on Mar. 18, 2014. The above identified patent application is herein incorporated by reference in its entirety to provide continuity of disclosure.

BACKGROUND OF THE INVENTION

Field of the Invention

The present invention relates to blankets or coverings. More specifically, the present invention relates to blankets or coverings that are adapted to be attached to a wheelchair.

Description of the Prior Art

Individuals who use wheelchairs often place a blanket over their legs in order to protect themselves from inclement weather, such as extreme cold and rain. Unfortunately, these blankets can create pressure sores if packed too tightly around a user's legs and can make the individual very uncomfortable if they prevent airflow or trap too much heat thereunder. However, if the blanket is not wrapped tightly around the individual's legs and the blanket is simply laying across the user's lap, then the back portions of the user's legs are left exposed. Furthermore, blankets have a tendency to get caught in the wheelchair's wheels, ripping the blanket from the user's lap, potentially damaging the blanket, and making the wheelchair more cumbersome to maneuver. Therefore, there is a need in the prior art for a leg covering for wheelchair users that addresses all of the aforementioned issues.

Wheelchair blankets and coverings for a user's lower extremities either restrict airflow, making them very uncomfortable to wear for extended periods of time, or fail to protect the back portions of a user's legs. The present invention, on the other hand, comprises a covering that protects the backs of a user's legs and a mesh panel that improves airflow through the present covering, without allowing rainwater to enter the device.

The present invention substantially diverges in design elements from the prior art and consequently it is clear that there is a need in the art for an improvement to existing wheelchair covering and blanket devices. In this regard, the instant invention substantially fulfills these needs.

SUMMARY OF THE INVENTION

In view of the foregoing disadvantages inherent in the known types of wheelchair coverings now present in the prior art, the present invention provides a new wheelchair covering wherein the same can be utilized for providing convenience for the user when seeking to protect themselves from inclement weather, such as extreme cold or rain, in a comfortable and convenient manner.

It is therefore an object of the present invention to provide a new and improved wheelchair covering that has all of the advantages of the prior art and none of the disadvantages.

It is another object of the present invention to provide a wheelchair covering that protects the backs of a user's legs.

Another object of the present invention is to provide a wheelchair covering that has improved airflow therethrough, without exposing the user's legs to rainwater and other such liquid.

Yet another object of the present invention is to provide a wheelchair covering having a zippered front portion so that a user's legs or catheter can be easily accessed without having to remove the entire cover.

Yet another object of the present invention is to provide a wheelchair covering that is specifically shaped to conform to a wheelchair.

Still yet another object of the present invention is to provide a wheelchair covering that is securable to the wheelchair when in use so that it does not slip or fall therefrom.

Still yet another object of the present invention is to provide a wheelchair covering that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
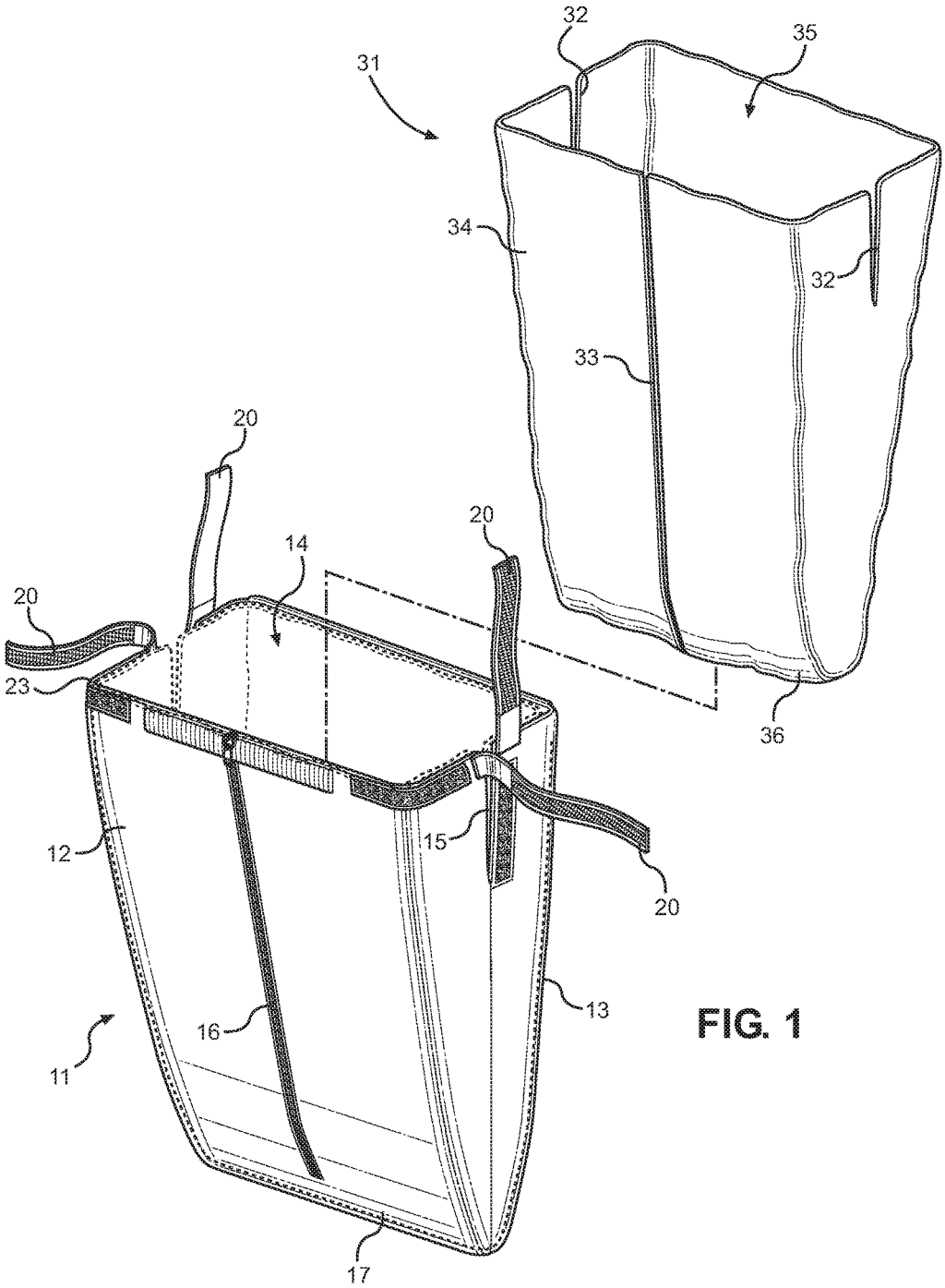
FIG. 1 shows a perspective view of the front portion of the present invention.

Reference is made herein to the attached drawings. Like reference numerals are used throughout the drawings to depict like or similar elements of the present wheelchair leg covering. For the purposes of presenting a brief and clear description of the present invention, the preferred embodiment will be discussed as used for protecting the legs of a wheelchair user from inclement weather, such as extreme cold and rain. The figures are intended for representative purposes only and should not be considered to be limiting in any respect.

Referring now to FIG. 1, there is shown a perspective view of the front portion of the present invention. The present invention comprises a covering 11 adapted to surround a wheelchair users legs. The covering 11 comprises a front portion 12, a back portion 13, and an open end 14 adapted to accept a user's legs therethrough. The covering 11 comprises a substantially a partially enclosed body portion, a rounded, distal closed end 17 against which a users feet can rest, and an open end 14 disposed oppositely from the closed end 17. The front portion 12 and the back portion 13 of the body comprise equal lengths extending from the open end 14 to the closed end 17. The covering 11 is preferably of a unitary construction; however, the present leg covering may be composed of multiple pieces sewed or otherwise joined together as needed. The covering 11 is secured to a wheelchair or another such device via one or more straps 20 extending from a position adjacent to the open end 14.

The covering 11 has an enclosed internal volume sufficient to house the portion of a user's body from the waist down, i.e. the user's legs and waist region. The covering 11 is constructed from insulating material, such as cotton, or waterproof material, such as nylon. In some embodiments of the present invention, the covering 11 has a first layer composed of insulating material, which is disposed within the interior of the covering 11, and a second layer composed of waterproof material, which is disposed along the exterior of the covering 11. In some embodiments of the present invention, the first and second layers are integrally affixed together via sewn lines of connection, adhesives, or other such connectors. In other embodiments of the present invention, the covering 11 is composed of a single layer of insulating or waterproof material.

The present invention further comprises a liner 31 that is removably insertable into the interior volume of the covering 11. The liner comprises a body portion, a rounded closed end 36, and an open end 35 disposed adjacently to the closed end 36. The size and the shape of the liner 31 is substantially equal to the size and the shape of the covering 11, such that the exterior surface of the liner 31 rests flush against the interior surface of the liner 11 when the liner 31 is inserted therein. The liner is preferably composed of insulating material, such as cotton. The liner 31 provides a removable internal layer to the covering 11, thereby allowing the present invention to be adaptable for use in either warm or cold environmental conditions. In an alternative embodiment of the present invention, the liner 31 is removably affixable to the interior surface of the covering 11 via hook-and-loop fastener material or other such removable connectors.

The present invention further comprises a plurality of slits 15 disposed along the sides of the covering 11, adjacent to the open end 14. The slits 15 are adapted to allow the covering 11 to be fully pulled over the individual's lower extremities, without interference from the wheelchair. This ensures that the covering 11 is securely in place and does not slip or fall from the user when in use and adequately protects the user's legs and waist regions from inclement weather. A slit 15 may be centrally positioned between the front portion 12 and the back portion 13 of the body. In the depicted embodiment of the present invention, the slits 15 are substantially triangular in shape; however, no claim is made as to slits of a particular size or shape. With many blankets and coverings used with wheelchairs, the handle bar portions of the wheelchair obstruct the blanket or covering from being fully pulled up. Alternatively, if the user is able to fully pull up the blanket, the blanket may be too tight against the individual's legs, potentially resulting in pressure sores. The slits 15 alleviate both of these issues by allowing the covering 11 to be situated around the handle bar portions of the wheelchair and pulled over the seat of the wheelchair so that the blanket does not bunch between the seat of the wheelchair and the user's legs, thereby preventing the blanket from putting pressure on the user's legs. The liner 31 comprises complementary slits 32 disposed at a position such that the liner slits 32 are aligned with the covering slits 15 when the liner 31 is placed within the covering 11.

The covering 11 further comprises an openable line of connection 16 disposed on the front portion 12 thereof, such as a zipper. The openable line of connection 16 is adapted to give individuals temporary, reversible access to the user's legs, without having to remove the entire covering 11 therefrom. The openable line of connection 16 also provides access to catheters, colostomy bags, or other such objects stored beneath the covering 11 in a discrete manner. Similarly, the liner 31 comprises a front slit 33 or opening disposed on the liner front portion 34 that provides access to the user's legs therethrough when the liner 31 is placed within the covering 31. The front slit 33 of the liner 31 is positioned so that it is aligned with the openable line of connection 16.

Figure 2:
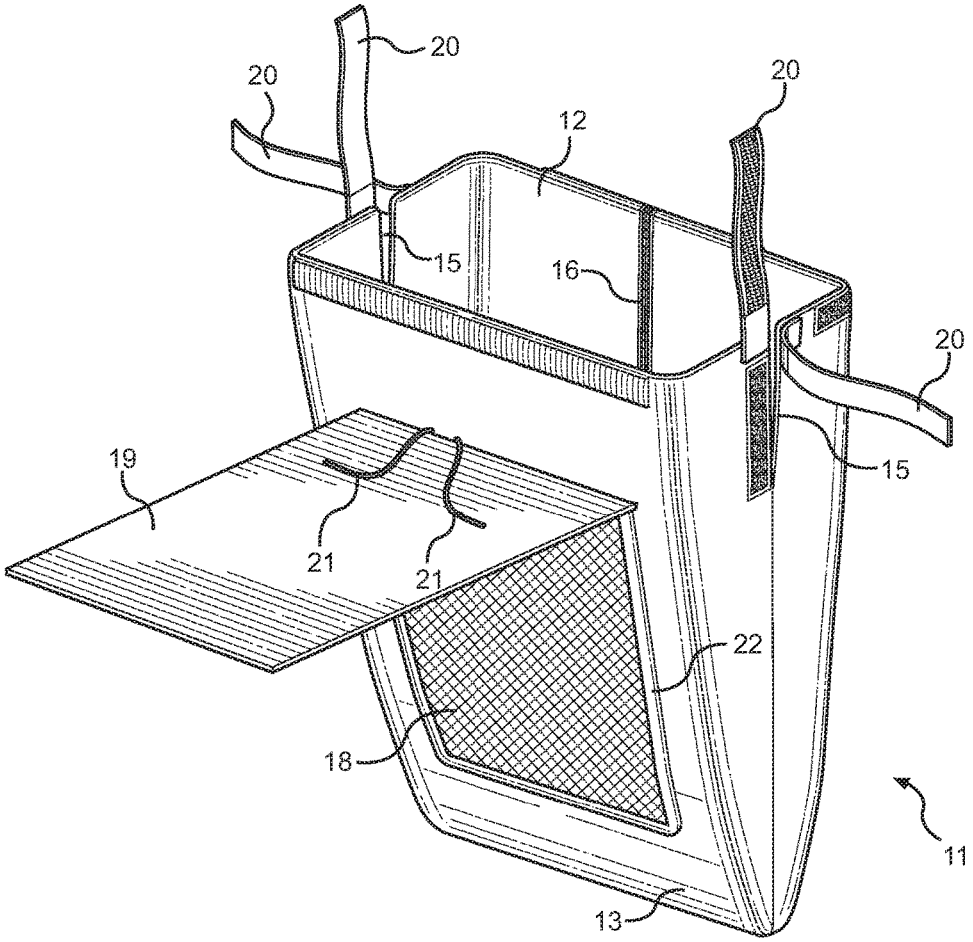
FIG. 2 shows a perspective view of the back portion of the present invention.
Figure 3:
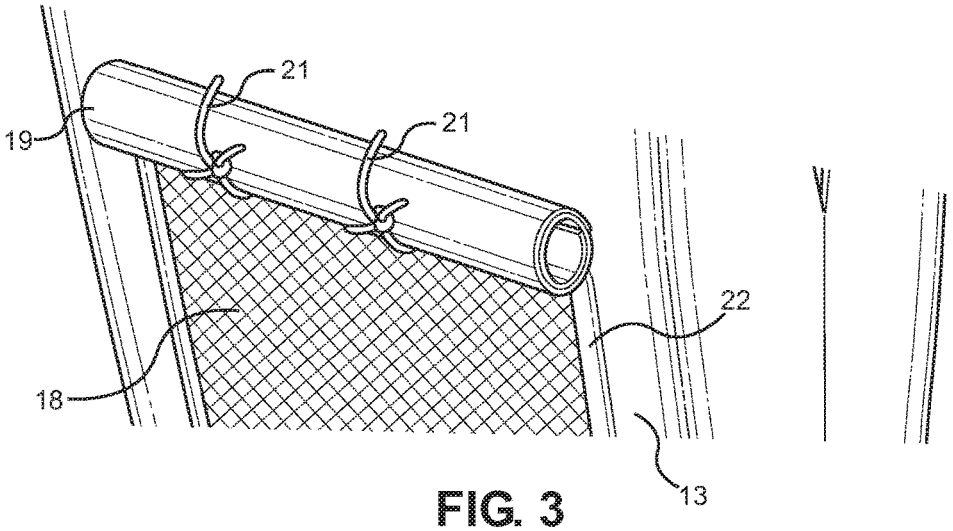
FIG. 3 shows a close-up view of the flap rolled up over the mesh panel of the present invention.

Referring now to FIGS. 2 and 3, there are shown a perspective view of the back portion of the present invention and a close-up view of the flap rolled up over the mesh panel of the present invention. The present invention further comprises a mesh panel 18 disposed on the back portion 13 of the covering and a flap 19 that is disposed along the top edge of the mesh panel 18. The mesh panel 18 consists of conventional mesh material, allowing for improved airflow through the covering 11 in order to provide relief to the user without forcing the user to completely expose his or her legs to the surrounding environment. When unsecured, the flap 19 rests over the mesh panel 18, covering the mesh panel 18 and preventing the flow of air and heat therethrough. When desired by the user, the flap 19 may also be removably secured via one or more fasteners 21 such that the mesh panel 18 is left uncovered. In the depicted embodiment of the present invention, the fasteners 21 comprise ties that are used to secure the rolled-up cover. However, the present disclosure also contemplates fasteners 21 comprising snap-lock buttons and other such removable connections. The size of the flap 19 is substantially equal to that of the mesh panel 18, ensuring that the mesh panel 18 is fully covered thereby.

The mesh panel 18 further comprises a lip 22 extending along the side and bottom peripheral edges thereof. The lip 22 is a raised surface adapted to partially block precipitation from entering the interior volume of the covering 11 via the mesh panel 18. The lip 22 may be composed of the same material as that of the covering 11 or it may be composed of a different material, such as rubber, plastic, and the like.

The covering 11 is secured to a wheelchair via one or more straps 20 extending from the exterior surface of the covering 11, adjacent to the upper open end 14. The depicted embodiment of the present invention comprises four straps 20, two of which are situated parallel to the longitudinal axis of the covering 11 and two of which are situated perpendicular to the longitudinal axis of the covering 11; however, no claim is made as to a specific number or orientation of the straps 20. The straps 20 may comprise a first set of straps 20 disposed along a first side of the at least one slit 15 and a second set of straps 20 disposed along a second side of the at least one slit 15. The first set of straps 20 and the second set of straps 20 may each extend from laterally parallel positions along an upper peripheral edge 23 of the covering 11. The first set of straps 20 may be disposed along a periphery of a first side of the at least one slit 15 and the second set of straps 20 may be disposed along the periphery of a second side of the at least one slit 15. Each of the straps 20 comprises complementary mating surfaces of hook-and-loop fastener material, i.e. Velcro, or another such connector that allows for the covering 11 to be removably affixed to a wheelchair. The straps 20 are preferably composed of elastic or otherwise stretchable material that allows the straps to accommodate a number of different designs of wheelchairs or differently sized individuals. However, straps 20 composed of non-elastic or non-stretchable material are also contemplated by the present disclosure.

Figure 4:
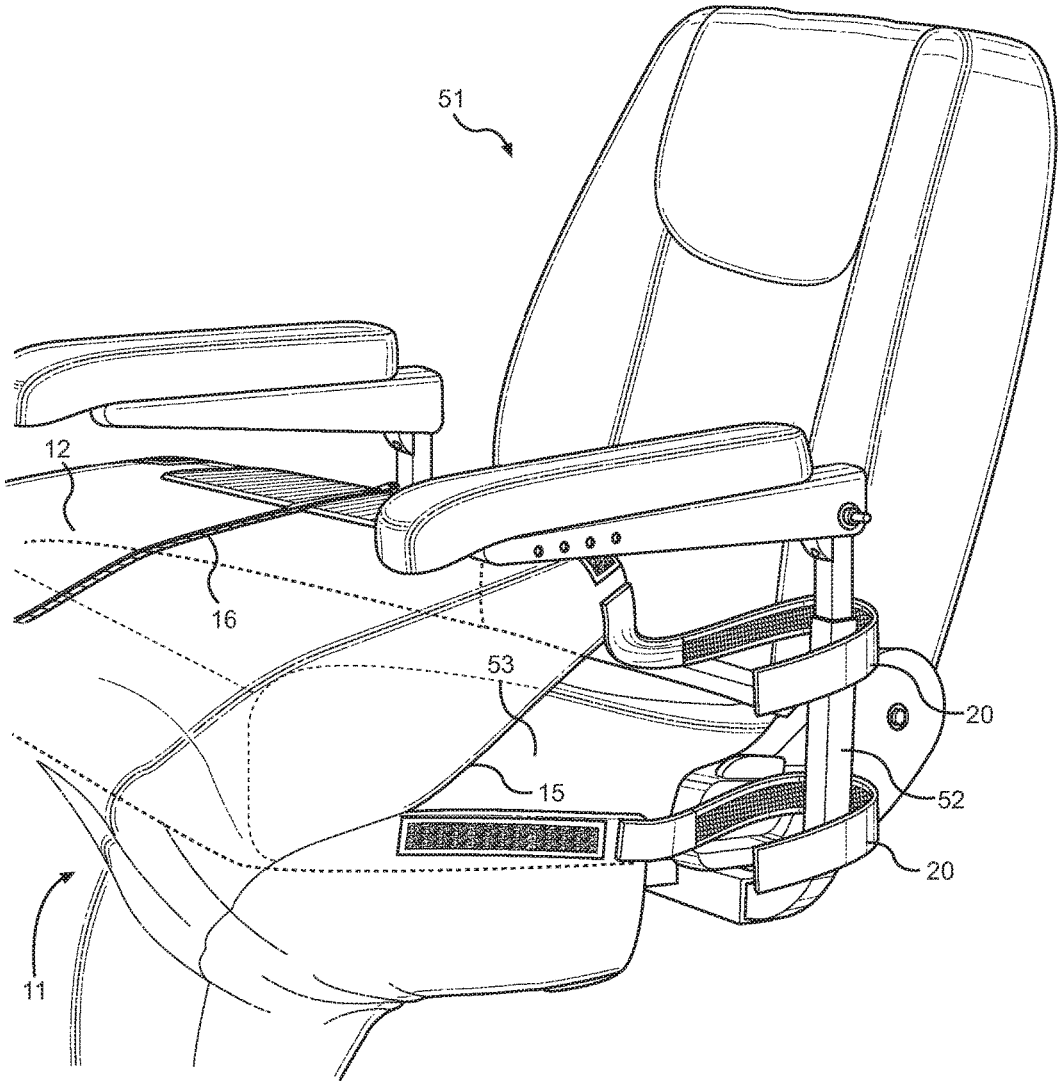
FIG. 4 shows a close up view of the present invention secured to a wheelchair.

Referring now to FIG. 4, there is shown a close up view of the present invention secured to a wheelchair 51. The slits 15 allow the present invention to be drawn over and around the wheelchair seat 53 so that the material of the covering 11 does not bunch up between the wheelchair seat 53 and the user's legs, which can place a substantial amount of pressure on the user's legs and potentially result in pressure sores. Once drawn over the user's legs, the straps 20 are used to secure the covering 11 to the wheelchair armrests 52 or any other such portion of the wheelchair 51. The depicted embodiment of the present invention comprises four straps 20, two of which are situated parallel to the longitudinal axis of the covering 11 and two of which are situated perpendicular to the longitudinal axis of the covering 11. The different orientations of the straps 20 allows for different straps 20 to be secured to different portions of the armrests 52. For example, the set of straps 20 situated perpendicularly to the longitudinal axis of the covering 11 can be secured around the pad of the armrest 52 and the other set of straps 20 can be secured around the frame of the armrest 52. Alternatively, the straps 20 may be secured to the same portion of the armrests 52, as depicted.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leg covering, comprising: a covering having a body, a closed end, and an open end; at least one slit disposed on a side portion of said covering, wherein said at least one slit extends from said open end towards said closed end, such that said covering is adapted to be pulled partially over a seat of a wheelchair; an openable line of connection disposed on a front portion of said body; at least one strap disposed on said cover, adjacent to the open end; wherein said at least one strap comprises a first set of straps disposed along a first side of said at least one slit and a second set of straps disposed along a second side of said at least one slit; wherein said first set of straps and said second set of straps each extend from laterally parallel positions along an upper peripheral edge of said covering; wherein the at least one strap is adapted to removably secure the covering to an armrest of a wheelchair; a mesh panel disposed on a back portion of said body, the mesh panel having a flap movably securable thereover.

2. The leg covering of claim 1, further comprising:

a liner comprising a body, a closed end, and an open end;

wherein the liner is removably insertable into the covering and adapted to conform to the covering.

3. The leg covering of claim 2, further comprising:

an opening disposed on a front portion of the body of the liner;

wherein the opening is adapted to align with the openable line of connection when the liner is inserted into the covering.

4. The leg covering of claim 2, wherein:

the liner comprises insulating material;

the covering comprises weatherproof material.

5. The leg covering of claim 1, wherein the covering comprises insulating material.

6. The leg covering of claim 1, wherein the covering comprises weatherproof material.

7. The leg covering of claim 1, further comprising a lip extending around a peripheral edge of the mesh panel.

8. The leg covering of claim 1, wherein said first set of straps is disposed parallel to a longitudinal axis of the covering and said second set of straps is disposed perpendicular to the longitudinal axis of the covering.

9. The leg covering of claim 1, wherein the flap is securable such that the mesh panel is exposed via one or more fasteners.

10. The leg covering of claim 9, wherein the fasteners comprise ties.

11. The leg covering of claim 1, wherein the openable line of connection comprises a zipper.

12. The leg covering of claim 1, wherein said at least one slit is centrally positioned between said front portion and said back portion of said body.

13. The leg covering of claim 1, wherein said front portion and said back portion of said body comprise equal lengths extending from said open end to said closed end of said body.

14. The leg covering of claim 1, wherein said first set of straps is disposed along a periphery of said first side of said at least one slit and said second set of straps is disposed along said periphery of said second side of said at least one slit.

* * * * *